United States Patent [19]

Feldkämper et al.

[11] 4,357,139

[45] Nov. 2, 1982

[54] APPARATUS FOR DEPOSITING SECTIONS WELDED OFF FROM A WEB OF FILM

[75] Inventors: Richard Feldkämper; Fritz Achelpohl, both of Lengerich; Aloys Winnemöller, Rheine, all of Fed. Rep. of Germany

[73] Assignee: Windmöller & Hölscher, Lengerich, Fed. Rep. of Germany

[21] Appl. No.: 167,224

[22] Filed: Jul. 9, 1980

[30] Foreign Application Priority Data

Jul. 12, 1979 [DE] Fed. Rep. of Germany ..... 2928251

[51] Int. Cl.[3] ..... B65H 29/32; B31B 1/98

[52] U.S. Cl. ..... 493/204; 271/186

[58] Field of Search ..... 271/186; 493/204, 203, 493/196, 195, 194; 83/324

[56] References Cited

U.S. PATENT DOCUMENTS

| | | | |
|---|---|---|---|
| 2,177,465 | 10/1939 | Sieg | 83/324 X |
| 3,308,701 | 3/1967 | Fröhling | 83/324 |
| 3,675,522 | 7/1972 | Hull | 271/196 X |
| 3,893,382 | 7/1975 | Bosse et al. | 493/194 |
| 4,027,580 | 6/1977 | Sundin | 271/186 X |
| 4,083,747 | 4/1978 | Rochla | 493/201 X |
| 4,128,049 | 12/1978 | Lehmacher | 493/194 |

FOREIGN PATENT DOCUMENTS

| | | | |
|---|---|---|---|
| 2354963 | 5/1975 | Fed. Rep. of Germany | 493/194 |
| 2825156 | 12/1979 | Fed. Rep. of Germany | 493/194 |
| 1061145 | 3/1967 | United Kingdom . | |
| 1296531 | 11/1972 | United Kingdom . | |
| 1536877 | 12/1978 | United Kingdom . | |

*Primary Examiner*—James F. Coan

*Attorney, Agent, or Firm*—Fleit & Jacobson

[57] ABSTRACT

Apparatus for successively depositing sections severed from the leading end of a web of film on a support to form a stack in which the sections are staggered comprises an output shaft carrying two suction tubes or suction tube rows which engage a respective section and transfer it to the support as the output shaft is turned intermittently by interconnected crank arms from an input shaft which is horizontally offset from the output shaft and parallel thereto. The tubes or rows of tubes include an obtuse angle and are alternately revolved by the output shaft through the obtuse angle and the explement thereof.

5 Claims, 2 Drawing Figures

APPARATUS FOR DEPOSITING SECTIONS WELDED OFF FROM A WEB OF FILM

Figure 1:
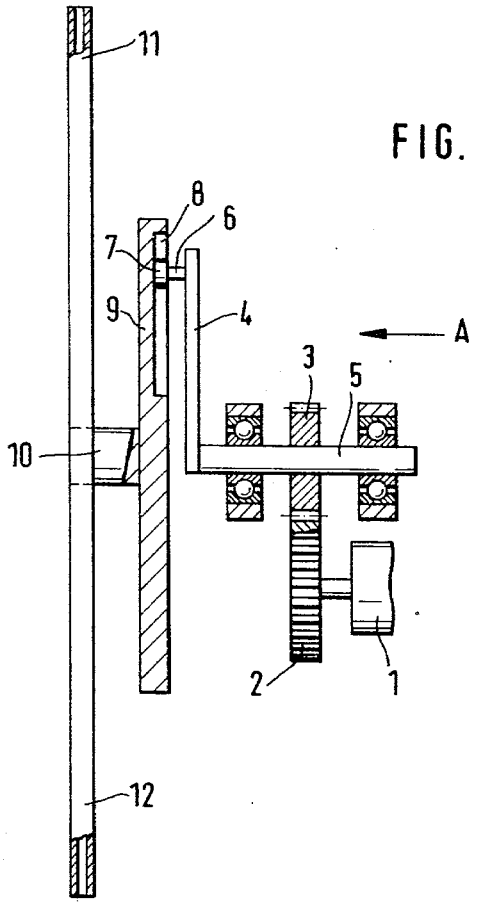

The invention relates to an apparatus for depositing sections severed from a web of film fed between transverse welding and transverse severing means, comprising air jet nozzles disposed on both sides of the web and stretching its freely advanced end, means holding the sections at their margins facing the nozzles, and two suction tubes or suction tube rows which engage the leading film end stretched by the air jet, are provided with suction nozzles at the ends, are suitably oppositely secured to a shaft turning through predetermined angular steps, and, after severing of the section, transfer its suction-attracted zone to the holding means disposed beyond the air jet stretching the web, according to U.S. patent application Ser. No. 110,458, filed Jan. 8, 1980.

In the apparatus according to the referenced patent application, provision is made for the shaft to pivot intermittently in sequence with the severing or welding-off of the sections through 180° between the suction-attracting position and the transferring position of the suction tube or suction tube rows so that, in the stack being formed by depositing the sections, the respective weld seams formed last of all are superposed on each other. Although the weld seams are subjected to a certain amount of cooling during pivoting of the sections onto the support or onto the stack being formed thereon, they are often still so tacky that the superposed weld seams may become joined to each other which can present difficulties when the individual sections are later withdrawn from the stack.

It is therefore the problem of the present invention to improve the apparatus of the referenced patent application in such a way that joining or adhesion of the weld seams is no longer a danger for the sections deposited on the support.

According to the invention, this problem is solved in that the suction tubes or suction tube rows include an obtuse angle only a little less than 180° and step gearing is provided which turns the shaft in sequence with depositing the sections alternately through the obtuse angle and the explement thereof. In the apparatus according to the invention, the upper suction tubes or suction tube rows which suction-attract the sections are always in the same position after each angular step. If, now, the shaft is turned through a smaller angular step, the suction tubes will deposit the suction-attracted end of the section in front of the plane in which the suckers were disposed in their suction-attracting position. Prior to pivoting through the smaller angular step, the other suction row was located behind said plane by the same amount so that it is in the suction-attracting position after the shaft is turned. If, now, the shaft is turned through the larger angular step during the subsequent depositing cycle, the suction row disposed in front of the plane defined by the suction row located in the suction-attracting position will again be precisely in its suction-attracting position whereas the other suction row is swung out of the suction-attracting position beyond the plane by the same amount as the suction row in the suction-attracting position had previously been located in front of said plane. The suction tubes or suction tube rows consequently deposit the sections on the support in a staggered relationship to each other. In the apparatus according to the invention, the obtuse angle which is included by the suction tubes or suction tube rows differs from 180° to such an extent that the staggering substantially corresponds to the width of the weld seam.

In a further embodiment of the invention, it is provided that a crank drive for the shaft comprises a slide block secured on the crank arm and a counter crank arm having a slideway for the slide block, that the rotary axes of the crank arms are disposed parallel to each other at a spacing in a horizontal plane, and the driven crank arm is intermittently driven by step gearing through angular steps of 180°. Stepping motors and step gearing which execute 90° or 180° at a time are commercially available. If the driven crank arm is intermittently turned through 180° at a time, then, after two angular steps, the shaft carrying the suction tubes or suction tube rows executes one angular step with a larger angle and one angular step with a smaller angle. The different size of the two angular steps can simply be set by the eccentricity of the rotary axes of the two crank arms.

Figure 2:
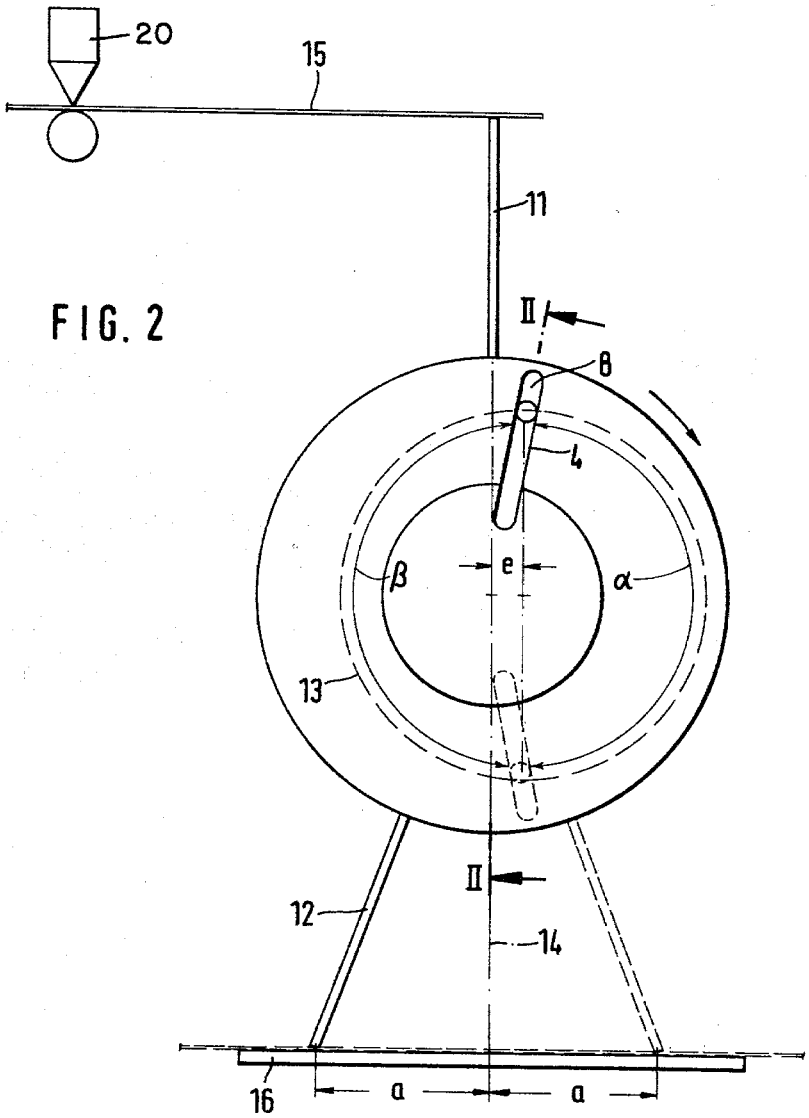

One example of the invention will now be described in more detail with reference to the drawing, wherein:

FIG. 1 is a diagrammatic longitudinal section through the suction tubes and the crank drive, and FIG. 2 is an elevation of the crank drive in the direction of the arrow A in FIG. 1.

By means of the stepping motor 1 which executes angular steps of 90° at a time, the shaft 5 carrying the crank arm 4 is intermittently turned through 180° at a time by way of the pair of spur gears 2, 3 having the ratio 1:2. The end of the crank arm 4 comprises a pin 6 to which a slide block in the form of a ball bearing 7 is secured. The ball bearing 7 is guided in the slideway 8 disposed in the counter crank arm 9 which is secured on the shaft 10 carrying the suction tubes 11, 12. The counter crank arm 9 could also consist of a disc.

As will be seen from FIG. 2, the centrelines of the shafts 5, 10 are offset from each other in a horizontal plane by the eccentricity e. The result of this is that the crank arm or the disc 9 turns through the angle $\alpha$ when the crank arm 4 is pivoted out of its full line position in FIG. 2 through 180° to the position shown in broken lines. If during the next cycle the crank arm 4 is again turned to its full line position on the crank circle 13 shown in broken lines, the disc 9 secured to the shaft 10 executes an oscillation through the larger angle $\beta$.

During each turn through 180° by the shaft 5, the suction tube shaft 10 turns the suction tubes out of their upper suction-attracting position alternately to the lower positions shown in full and broken lines, which are each disposed by the same angular amount in front of and behind the plane 14 in which the suckers are disposed in their suction-attracting position. The sections 15 which are provided with head and severed by transverse welding and transverse severing means 20 base weld seams and are suction-attracted by the suction tubes or suction tube rows in the upper position are therefore staggered by the distance 2*a* when deposited on the support 16 after pivoting through 180°.

For explanatory purposes, the distance 2*a* is exaggerated in FIG. 2. In reality, this distance only corresponds to about the width of the weld seam so that adhesion of the weld seams is effectively prevented. For stacking purposes, the sections deposited on the plate 16 are fixed by means (not shown) which are for example described in the referenced patent application.

We claim:

1. Apparatus for transferring severed sections from a transverse welding and transverse severing means to a support, said apparatus comprising:

first and second suction tube means having outer ends for suction attracting a severed section;

a shaft supporting inner ends of said suction tube means so that outer ends of said first and said second suction tube means are spaced from each other by an obtuse angle ($\alpha$) slightly less than 180°;

means for rotating said shaft so that said first and said second suction tube means are alternately moved between a vertically extending orientation for engaging a section to be transferred and a deposit position for depositing a transferred section on the support, said means for rotating alternately rotating said shaft through the obtuse angle ($\alpha$) and the explement ($\beta$) thereof.

2. Apparatus according to claim 1, wherein said first and second suction tube means each comprises a suction tube.

3. Apparatus according to claim 1, wherein said first and second suction tube means each comprises suction tube rows.

4. Apparatus according to one of claims 1, 2 or 3, wherein said means for rotating comprises:

a first crank arm;

a slide block secured on an end of said first crank arm;

a counter crank arm connected to said shaft and having a slideway formed therein for receiving said slide block, said first and said counter crank arms being rotatable about parallel spaced apart horizontally extending axes; and step gearing means for intermittently rotating said first crank arm through angular steps of 180° so that said counter crank arm rotates said shaft alternately through the obtuse angle ($\alpha$) and the explement ($\beta$) thereof.

5. Apparatus according to claim 4, wherein the axes of said first and said counter crank arms are in the same horizontal plane.

* * * * *